US008228281B2

(12) United States Patent
Woo

(10) Patent No.: US 8,228,281 B2
(45) Date of Patent: Jul. 24, 2012

(54) GATE DRIVING CIRCUIT AND REPAIR METHOD THEREOF, AND LIQUID CRYSTAL DISPLAY USING THE SAME

(75) Inventor: Choel Min Woo, Geongsangbuk-do (KR)

(73) Assignee: LG Display Co., Ltd., Seoul (KR)

( * ) Notice: Subject to any disclaimer, the term of this patent is extended or adjusted under 35 U.S.C. 154(b) by 1113 days.

(21) Appl. No.: 11/600,185

(22) Filed: Nov. 16, 2006

(65) Prior Publication Data

US 2007/0109250 A1 May 17, 2007

(30) Foreign Application Priority Data

Nov. 17, 2005 (KR) ..... 10-2005-0110206

(51) Int. Cl.
*G09G 3/36* (2006.01)

(52) U.S. Cl. ..... 345/100

(58) Field of Classification Search ..... 345/100, 345/204; 377/64–81
See application file for complete search history.

(56) References Cited

U.S. PATENT DOCUMENTS 5,063,378 A 11/1991 Roach
5,926,156 A * 7/1999 Katoh et al. ..... 345/55
7,636,077 B2 * 12/2009 Wei et al. ..... 345/100

FOREIGN PATENT DOCUMENTS

EP 0 601 650 A1 6/1994
JP 01-125951 5/1989
JP 8-313931 A 11/1996
JP 2000-275669 A 10/2000

OTHER PUBLICATIONS

English Translation of JP01-125951A.*
Office Action issued Sep. 28, 2009 in corresponding Japanese Application No. 2006-302271.

* cited by examiner

*Primary Examiner* — Sumati Lefkowitz
*Assistant Examiner* — Robert E Carter, III
(74) *Attorney, Agent, or Firm* — Morgan, Lewis & Bockius LLP

(57) ABSTRACT

A gate drive device includes first, second and third stages, each of which for shifting a signal from an input thereof to an output thereof; and a dummy stage having a substantially similar circuit configuration as one of the first, second and third stages, the dummy stage for shifting a signal from an input thereof to an output thereof, wherein the first stage shifts a first start signal from the input thereof for outputting a second start signal to the output thereof, the dummy stage shifts the second start signal from the input thereof for outputting a third start signal to the output thereof, and the third stage shifts the third start signal from the input thereof to the output thereof.

15 Claims, 7 Drawing Sheets

(a)

(b)

GATE DRIVING CIRCUIT AND REPAIR METHOD THEREOF, AND LIQUID CRYSTAL DISPLAY USING THE SAME

This application claims the benefit of the Korean Patent Application P05-0110206 filed on Nov. 17, 2005, which is hereby incorporated by reference in its entirety.

BACKGROUND OF THE INVENTION

1. Field of the Invention

Embodiments of the present invention relates to a liquid crystal display (LCD) device, and more particularly, to a gate drive circuit for an LCD device. Embodiments of the present invention are suitable for a wide scope of applications. In particular, an embodiment of the present invention is suitable for providing a gate drive circuit with a reduced defect rate, a method of repairing the gate drive circuit, and an LCD device using the gate drive circuit.

2. Description of the Related Art

Recently, gate in panel (GIP) type LCD devices have been gaining in interest because they are relatively light and thin. In a GIP LCD, a gate drive circuit is embedded in an LCD panel. This structure allows the GIP LCD to be fabricated at a reduced manufacturing cost.

FIG. 1 is a schematic description of an LCD device in accordance with the related art. Referring to FIG. 1, the related art GIP-type LCD device includes an LCD panel 3, a gate drive circuit 2 and a data drive circuit 1. The LCD panel 3 includes a plurality of gate lines G1 to Gn and a plurality of data lines D1 to Dm crossing each other. The LCD panel 3 is formed by putting a liquid crystal material between a lower array substrate and an upper array substrate to provide a liquid crystal cell Clc at each crossing of the gate lines G1 to Gn and the data lines D1 to Dm.

A thin film transistor TFT is formed at each crossing of the gate lines G1 to Gn and the data lines D1 to Dm to drive the corresponding liquid crystal cell Clc. The gate drive circuit 2 sequentially supplies a scan pulse to the gate lines G1 to Gn. The data drive circuit 1 supplies a data voltage to the data lines D1 to Dm of the LCD panel 13. The TFT supplies the data voltage from the data lines D1 to Dn to the liquid crystal cell Clc in response to the scan pulse from the gate lines G1 to Gn. For example, a gate electrode of the TFT is connected to one of the gate lines G1 to Gn, a source electrode of the TFT is connected to one of the data lines D1 to Dm, and a drain electrode of the TFT is connected to a pixel electrode of the liquid crystal cell Clc.

The gate drive circuit 2 is formed on the lower array substrate for sequentially shifting a start signal at each horizontal period to generate the scan pulse to be sequentially supplied to the gate lines G1 to Gn. A black matrix, a color filter and a common electrode (not shown) are formed on the upper array substrate of the LCD panel 3. Polarizers having their optical axes crossing each other at a right angle are placed onto the upper and lower array substrates of the LCD panel 3, respectively. An alignment film is formed on the inner surface of one or more of the lower and upper array substrate for setting a pre-tilt angle of the liquid crystal material. A storage capacitor Cst is formed in each of the liquid crystal cells Clc of the LCD panel 3. The storage capacitor Cst is formed between the pre-stage gate line and a pixel electrode of the liquid crystal cell Clc or between a common electrode line (not shown) and the pixel electrode of the liquid crystal cell Clc to fixedly keep the voltage of the liquid crystal cell Clc.

The data drive circuit 1 includes a plurality of data drive IC's. Each of the data drive IC's includes a gate drive circuit, a latch, a digital-analog converter, and an output buffer. The data drive IC may be attached to the lower array substrate of the LCD panel 3 using a tape carrier package (TCP). The data drive IC may also be directly mounted on the lower array substrate of the LCD panel 3 by a chip-on-glass method. The data drive circuit 1 latches digital video data and converts the digital video data into an analog gamma compensation voltage to be supplied to the data lines D1 to Dm.

FIG. 2 is a schematic description of the gate drive circuit of FIG. 1 in accordance with the related art. Referring to FIG. 2, the gate drive circuit 2 includes an n-number of stages S1 to Sn connected in cascade. The first to $n^{th}$ stages S1 to Sn respectively includes input lines LI1 to LIn connected to start input terminals TI1 to TIn and output lines LO1 to LOn connected to output terminals TO1 to TOn, and shifts the start signal inputted through the input lines LI1 to LIn to the output lines LO1 to LOn. Each of the input lines LI2 to LIn of the second to $n^{th}$ stages S2 to Sn is connected to a previous one of the output lines LO1 to Lon−1 of a corresponding previous one of the stages S1 to Sn−1. For example, the second input line LI2 from stage S2 is connected to the first output line LO1 from stage S1, the third input line LI3 from stage S3 is connected to the second output line LO2 from stage S2, and so on.

As shown in FIG. 2, a start pulse Vst is inputted to the first stage S1 of the gate drive circuit 2 as a start signal for the first stage S1. Each of the pre-stage output signal LO1 to Lon−1 from each of the first to (n−1)th stages is inputted to the corresponding next stage from the second to $n^{th}$ stages S2 to Sn as the start signal for the corresponding next stage. Each of the stages S1 to Sn may have a similar circuit configuration and shifts the start pulse Vst or the corresponding pre-stage output signal LO1 to LOn−1 in response to a clock signal CLK to generate a scan pulse having a pulse width of one horizontal period.

FIG. 3 illustrates possible drive defects on a display screen of the related art LCD panel of FIG. 1. As shown in FIG. 3, when one of the stages S1 to Sn malfunctions because of impurities, a pattern defect, etc, i.e., the $k^{th}$ stage which supplies the scan pulse to the $k^{th}$ gate line among the first to $n^{th}$ gate lines G1 to Gn may operate abnormally. The abnormal operation of the $k^{th}$ stage causes a defective driving of the $k^{th}$ horizontal line 7 on a display screen 5 of the LCD panel as shown in part (a) of FIG. 3. The defective driving may extend to all the area below the $k^{th}$ horizontal line 7 on the display screen 5 of the LCD panel as shown in part (b) of FIG. 3.

Thus, in the related art GIP LCD panel, a defective gate drive circuit affects the entire LCD panel, thereby increasing manufacturing cost. To reduce the impact of defective LCD panels on manufacturing cost, there is need to provide a gate drive circuit with a reduced defect rate. The impact on the manufacturing cost can also be reduced by providing a method of repairing the gate drive circuit.

SUMMARY OF THE INVENTION

Accordingly, embodiments of the present invention are directed to a gate driving circuit and a repair method thereof, and a liquid crystal display device using the same that substantially obviate one or more of the problems due to limitations and disadvantages of the related art.

An object of an embodiment of the present invention is to provide a gate drive circuit that is repairable.

Another object of an embodiment of the present invention is to provide a method of repairing a gate drive device.

Another object of an embodiment of the present invention is to provide a liquid crystal display device that includes a repairable gate drive circuit.

Another object of an embodiment of the present invention is to provide a method of repairing a gate drive device in a liquid crystal device.

Additional features and advantages of the invention will be set forth in the description of exemplary embodiments which follows, and in part will be apparent from the description of the exemplary embodiments, or may be learned by practice of the exemplary embodiments of the invention. These and other advantages of the invention will be realized and attained by the structure particularly pointed out in the written description of the exemplary embodiments and claims hereof as well as the appended drawings.

To achieve these and other advantages and in accordance with the purpose of the present invention, as embodied and broadly described, a gate drive device includes first, second and third stages, each of which for shifting a signal from an input thereof to an output thereof; a dummy stage having a substantially similar circuit configuration as one of the first, second and third stages, the dummy stage for shifting a signal from an input thereof to an output thereof; a first dummy line partially overlapping the respective outputs of the dummy stage and of the first, second, and third stages with a first insulation layer between the first dummy line and each of the respective overlapped outputs; and a second dummy line partially overlapping the respective inputs of the dummy stage and of each of the first, second, and third stages with a second insulation layer between the second dummy line and each of the respective overlapped inputs, wherein the output of the first stage is electrically connected to the input of the second stage, and the output of the second stage is electrically disconnected from the input of the third stage, wherein, when the second stage malfunctions, the outputs of the dummy stage and of the second stage are electrically connected through the first dummy line by removing the first insulation layer between the first dummy line and each of the dummy stage and the second stage, the input of the dummy stage and of the second stage are electrically connected through the second dummy line by removing the second insulation layer between the second dummy line and each of the dummy stage and the second stage.

In another aspect, a gate drive device, includes first, second and third stages, each of which for shifting a signal from an input thereof to an output thereof; and a dummy stage having a substantially similar circuit configuration as one of the first, second and third stages, the dummy stage for shifting a signal from an input thereof to an output thereof, wherein the first stage shifts a first start signal from the input thereof for outputting a second start signal to the output thereof, the dummy stage shifts the second start signal from the input thereof for outputting a third start signal to the output thereof, and the third stage shifts the third start signal from the input thereof to the output thereof.

In another aspect, a method is provided for repairing a gate drive device, which includes first, second and third stages, each of which for shifting a signal from an input thereof to an output thereof, and a dummy stage having a substantially similar circuit configuration as one of the first, second and third stages, the dummy stage for shifting a signal from an input thereof to an output thereof. The method includes partially overlapping a first dummy line with the respective outputs of the dummy stage and of the first, second, and third stages; providing a first insulation layer between the first dummy line and each of the respective overlapped outputs; partially overlapping a second dummy line with the respective inputs of the dummy stage and of each of the first, second, and third stages; providing a second insulation layer between the second dummy line and each of the respective overlapped inputs, electrically connecting the output of the first stage to the input of the second stage, electrically connecting the outputs of the dummy stage and of the second stage through the first dummy line by removing the first insulation layer between the first dummy line and each of the dummy stage and the second stage, electrically connecting the input of the dummy stage and of the second stage through the second dummy line by removing the second insulation layer between the second dummy line and each of the dummy stage and the second stage, and electrically disconnecting the output of the second stage from the input of the third stage.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of embodiments of the present invention and are incorporated in and constitute a part of this application, illustrate embodiments of the present invention and together with the description serve to explain the principle of embodiments of the present invention. In the drawings.

DETAILED DESCRIPTION OF EXEMPLARY EMBODIMENTS

Reference will now be made in detail to the preferred embodiments of the present invention, examples of which are illustrated in the accompanying drawings. Wherever possible, the same reference numbers will be used throughout the drawings to refer to the same or similar parts.

Figure 1:
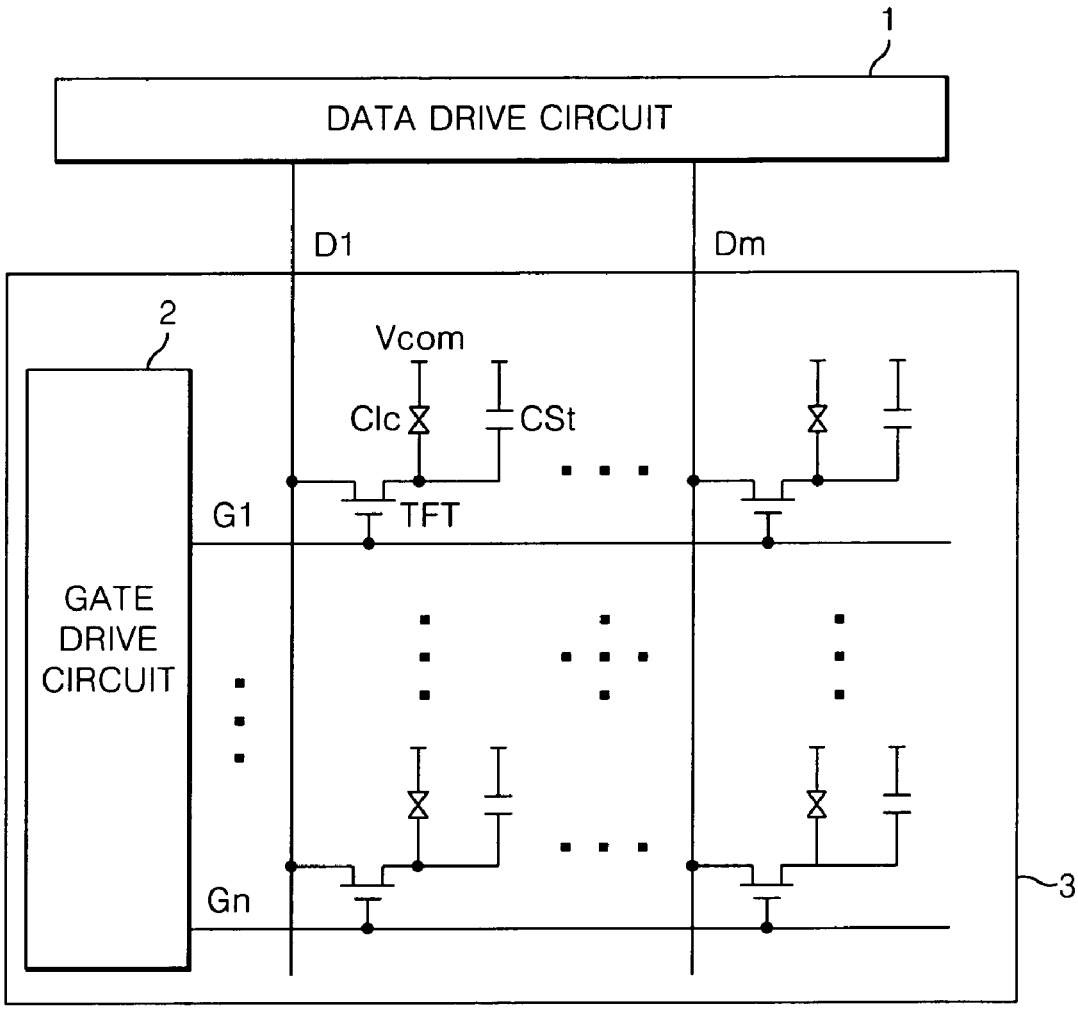
FIG. 1 RELATED ART
FIG. 1 is a schematic description of an LCD device in accordance with the related art.
Figure 2:
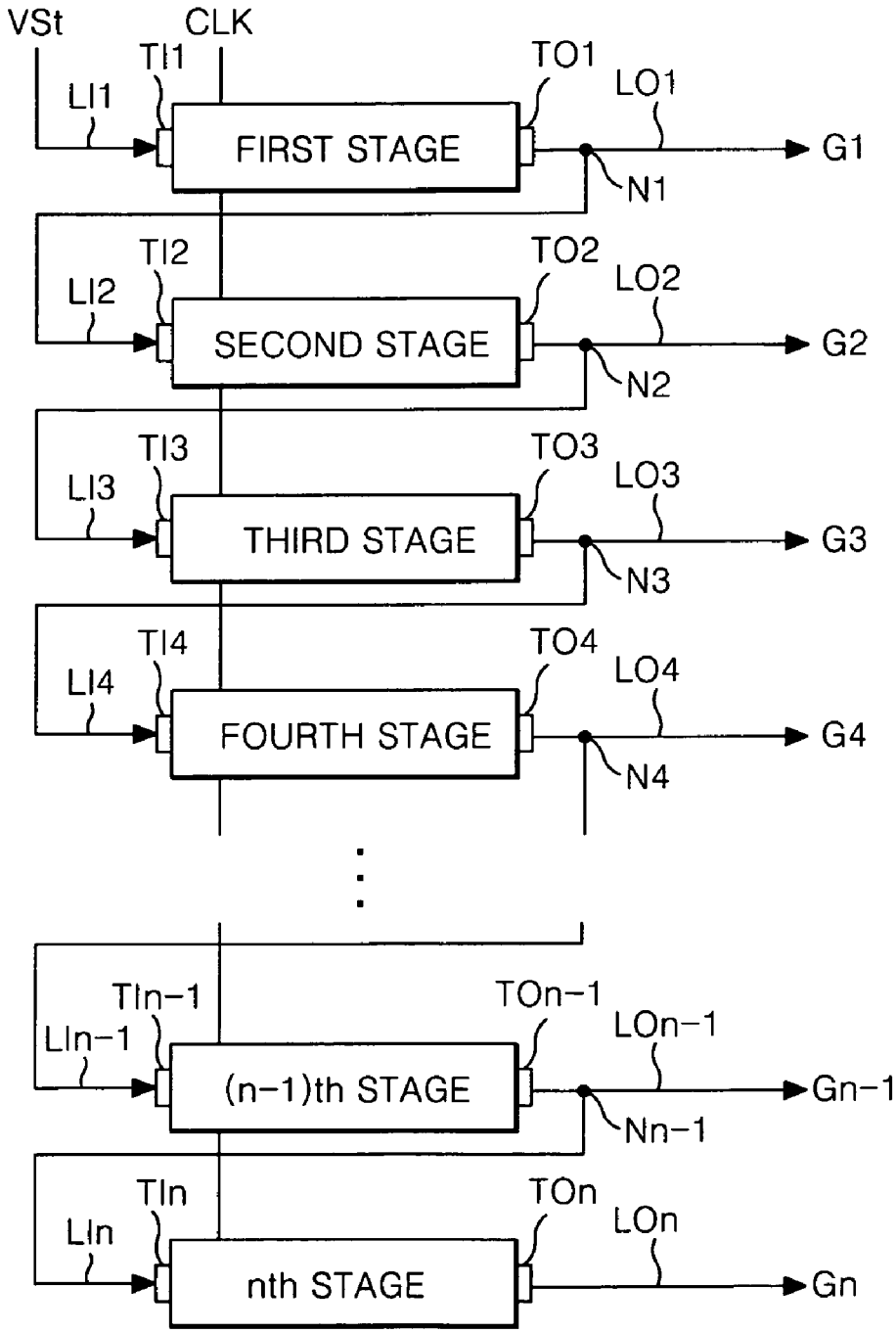
FIG. 2 RELATED ART
FIG. 2 is a schematic description of the gate drive circuit of FIG. 1 in accordance with the related art.
Figure 3:
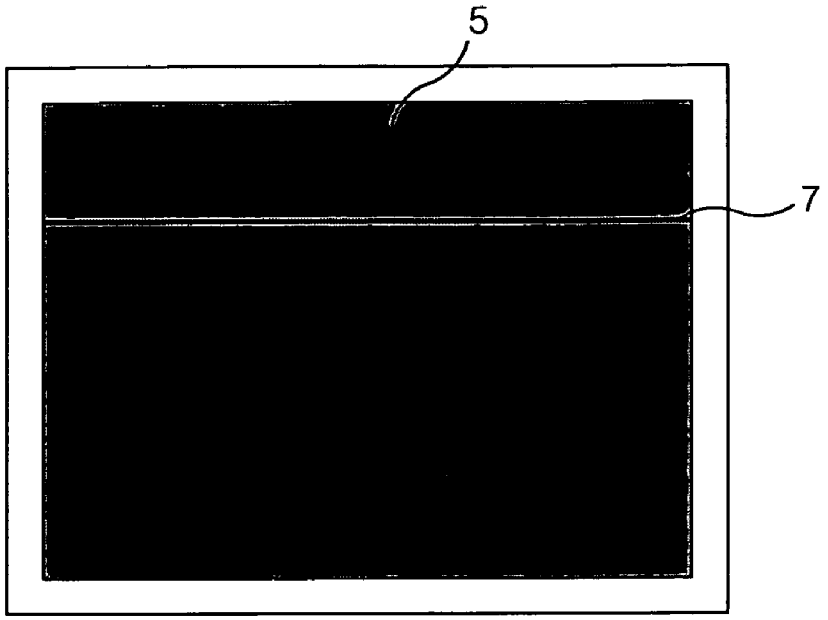
FIG. 3 RELATED ART
FIG. 3 illustrates possible drive defects on a display screen of the related art LCD panel of FIG. 1.
Figure 3:
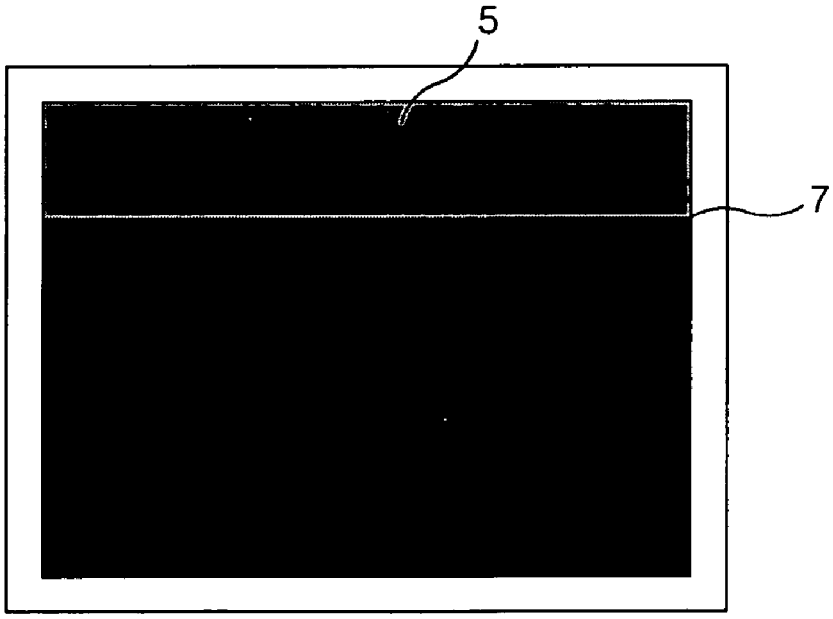
FIG. 3 RELATED ART
Figure 4:
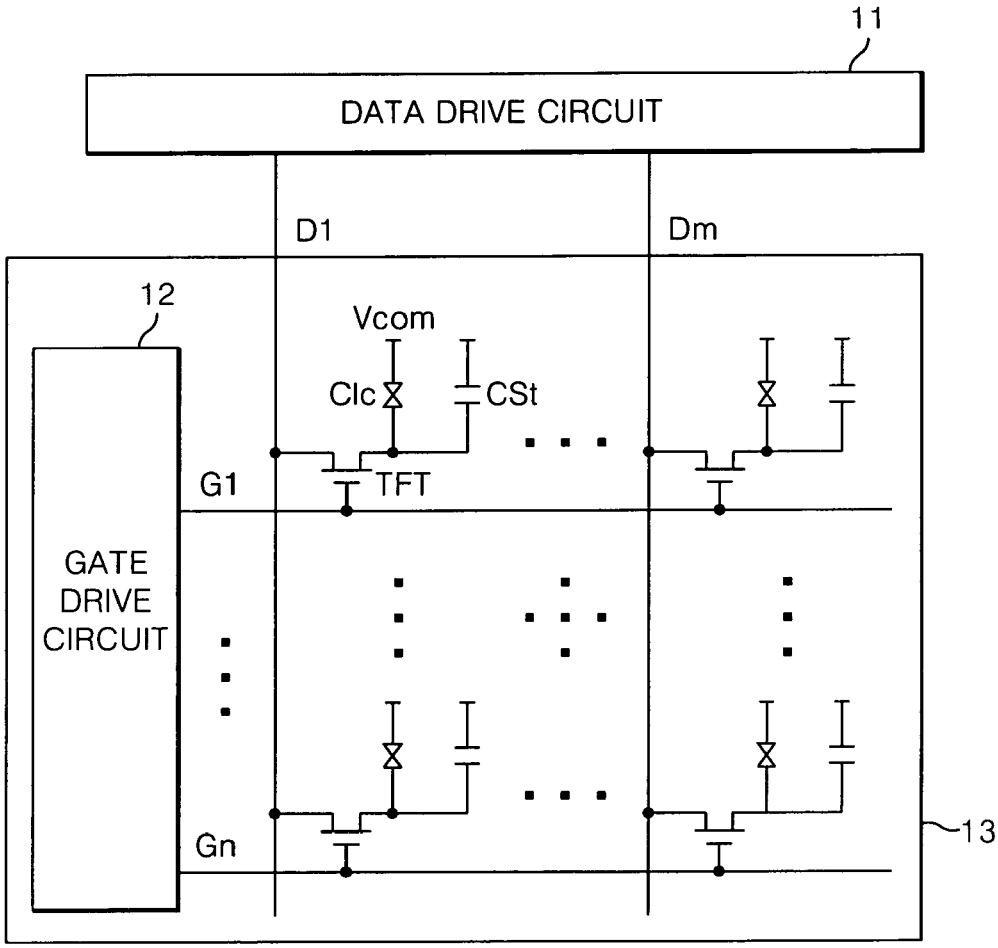
FIG. 4 is a schematic description of an exemplary LCD device according to an embodiment of the present invention.

FIG. 4 is a schematic description of an LCD device according to an embodiment of the present invention. Referring to FIG. 4, the GIP-type LCD device includes an LCD panel 13, a gate drive circuit 12 and a data drive circuit 11. The LCD panel 13 includes a plurality of gate lines G1 to Gn and a plurality of data lines D1 to Dm crossing each other. The LCD panel 13 is formed by putting a liquid crystal material between a lower array substrate and an upper array substrate to provide a liquid crystal cell Clc at each crossing of the gate lines G1 to Gn and the data lines D1 to Dm.

A thin film transistor TFT is formed at each crossing of the gate lines G1 to Gn and the data lines D1 to Dm to drive the corresponding liquid crystal cell Clc. The gate drive circuit 12 sequentially supplies a scan pulse to the gate lines G1 to Gn. The data drive circuit 11 supplies a data voltage to the data lines D1 to Dm of the LCD panel 13. The TFT supplies the data voltage from the data lines D1 to Dn to the liquid crystal cell Clc in response to the scan pulse from the gate lines G1 to Gn. For example, a gate electrode of the TFT is connected to one of the gate lines G1 to Gn, a source electrode of the TFT is connected to one of the data lines D1 to Dm, and a drain electrode of the TFT is connected to a pixel electrode of the liquid crystal cell Clc.

The gate drive circuit 12 is formed on the lower array substrate for sequentially shifting a start signal at each horizontal period to generate the scan pulse to be sequentially supplied to the gate lines G1 to Gn. A black matrix, a color filter and a common electrode (not shown) are formed on the upper array substrate of the LCD panel 13. Polarizers having their optical axes crossing each other at a right angle are placed onto the upper and lower array substrates of the LCD panel 13, respectively. An alignment film is formed on the inner surface of one or more of the lower and upper array substrates for setting a pre-tilt angle of the liquid crystal material. A storage capacitor Cst is formed in each of the liquid crystal cells Clc of the LCD panel 13. The storage capacitor Cst is formed between the pre-stage gate line and a pixel electrode of the liquid crystal cell Clc or between a common electrode line (not shown) and the pixel electrode of the liquid crystal cell Clc to fixedly keep the voltage of the liquid crystal cell Clc.

The data drive circuit 11 includes a plurality of data drive IC's. Each of the data drive IC's includes a gate drive circuit, a latch, a digital-analog converter, and an output buffer. The data drive IC may be attached to the lower array substrate of the LCD panel 13 using a tape carrier package (TCP). The data drive IC may also be directly mounted on the lower array substrate of the LCD panel 13 by a chip-on-glass method. The data drive circuit 11 latches digital video data, for example, and converts the digital video data into an analog gamma compensation voltage to be supplied to the data lines D1 to Dm.

Figure 5:
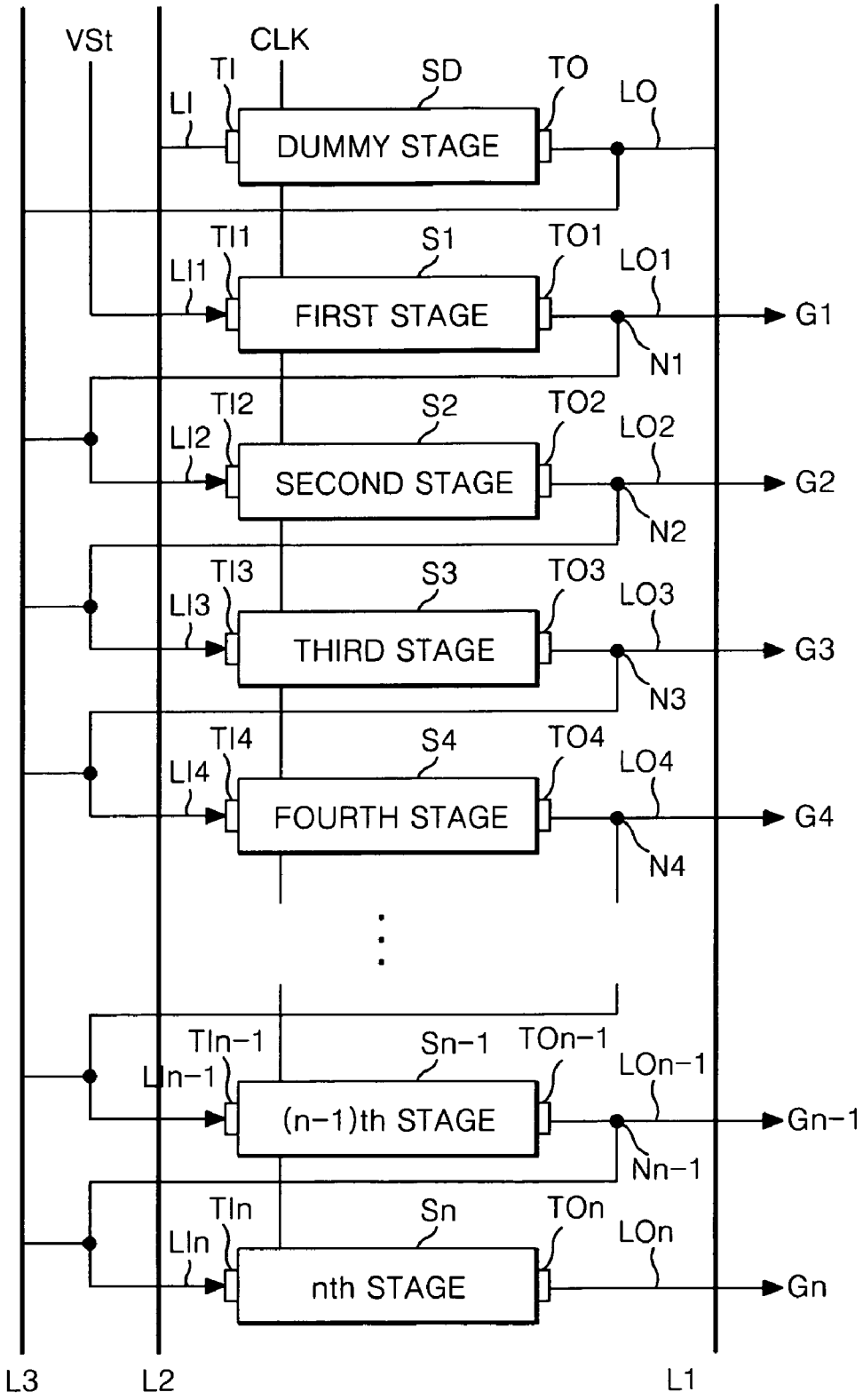
FIG. 5 is a schematic description of an exemplary repairable gate drive circuit according to an embodiment of the present invention.

FIG. 5 is a schematic description of an exemplary repairable gate drive circuit according to an embodiment of the present invention. Referring to FIG. 5, the gate drive circuit 12, shown in FIG. 4, includes first to $n^{th}$ stages S1 to Sn having respective input lines LI1 to LIn connected to start input terminals TI1 to Tin and respective output lines LO1 to LOn connected to output terminals TO1 to TOn. The input lines LI2 to LIn of the second to $n^{th}$ stages S2 to Sn are each connected to the output lines LO1 to LOn−1 of the respective previous stages S1 to Sn−1, respectively. A start pulse Vst is inputted to the input line LI1 of the first stage S1 as a start signal, and an output signal of a previous stage is inputted to the input line LI2 to LIn of the second to $n^{th}$ stage S2 to Sn as the start signal. For example, the output LO1 of the first stage S1 is inputted to input LI2 of the second stage S2 as a start pulse; the output LO2 of the second stage S2 is inputted to input LI3 of the third stage S3 as a start pulse, and so on. Each of the stages S1 to Sn shifts the start signal inputted through the corresponding one of the input lines LI1 to LIn to the corresponding one of the output lines LO1 to LOn in accordance with a clock signal CLK.

A dummy stage SD having a substantially similar circuit configuration as the one of the first to $n^{th}$ stages S1 to Sn is formed together with the first to $n^{th}$ stages S1 to Sn. For example, the dummy stage SD also includes the input line LI connected to the start input terminal TI and the output line LO connected to the output terminal TO. The start signal is inputted through the input line LI and is shifted in accordance with the clock signal CLK to the output line LO. The dummy stage SD is formed on the same substrate as the first to $n^{th}$ stages S1 to Sn.

The gate drive circuit 12 includes a first dummy line LI. The first dummy line L1 partially overlaps the output line LO of the dummy stage SD and the output lines LO1 to LOn of the first to $n^{th}$ stages S1 to Sn. An insulating layer (not shown) is provided between the first dummy line L1 and each of the overlapped output lines LO, and LO1 to LOn. The first dummy line LI may be electrically connected to the output line LO of the dummy stage SD and to the output line LOk of a $k^{th}$ stage Sk, where k is an integer from 1 to n by using laser irradiation.

The gate drive circuit 12 also includes a second dummy line L2. The second dummy line L2 partially overlaps the input line LI of the dummy stage SD and the input lines LI1 to LIn of the first to $n^{th}$ stages S1 to Sn. An insulating layer (not shown) is provided between the second dummy line L2 and each of the overlapped input lines LI, and LI1 to LIn. The second dummy line L2 may be electrically connected to the input line LI of the dummy stage SD and the input line LIk of the $k^{th}$ stage Sk, where k is an integer from 1 to n by using laser irradiation.

The gate drive circuit 12 further includes a third dummy line L3. The third dummy line LI3 partially overlaps the output line LO of the dummy stage SD and the input lines LI1 to LIn of the first to $n^{th}$ stages S1 to Sn. An insulating layer (not shown) is provided between the third dummy line L3 and each of the overlapped output line LO, and the overlapped input lines LI1 to LIn. The third dummy line L3 may be electrically connected to the output line LO of the dummy stage SD and to the input line LIk+1 of the $(k+1)^{th}$ stage Sk+1, where k is an integer from 1 to (n−1), by a laser irradiation. The first to $n^{th}$ stages S1 to Sn, the dummy stage SD and the first to third dummy lines L1 to L3 may be formed on the same substrate.

Figure 6:
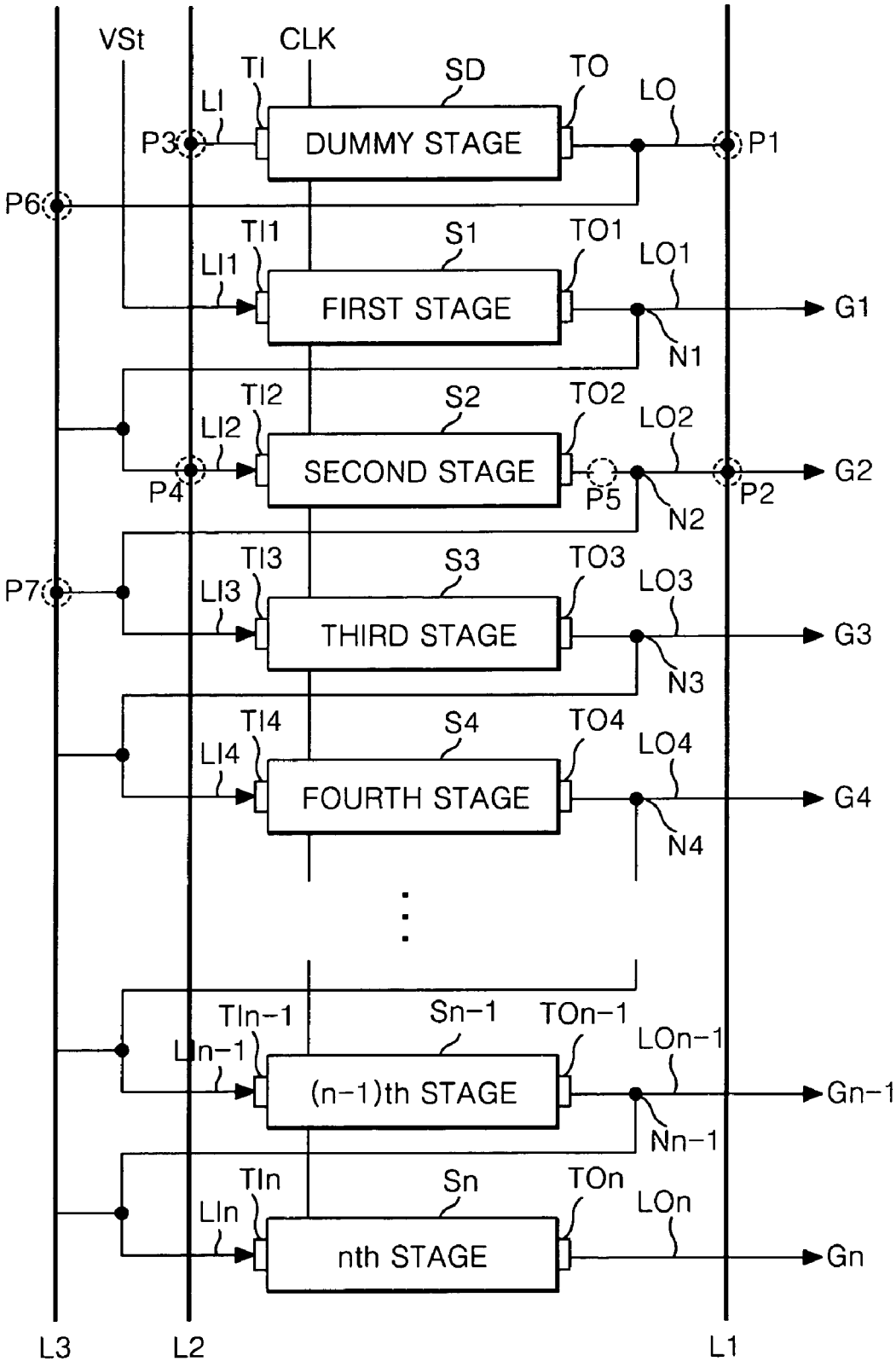
FIG. 6 is schematic description illustrating a method of repairing the repairable gate drive circuit of FIG. 5 according to an embodiment of the present invention.

FIG. 6 is schematic description illustrating a method of repairing the repairable gate drive circuit of FIG. 5 according to an embodiment of the present invention. Referring to FIG. 6, the second stage S2 of the gate drive circuit 12 fails to operate in a normal manner. The gate drive circuit 12 is repaired by irradiating a laser on an overlapping portion P1 of the first dummy line L1 and the output line LO of the dummy stage SD to electrically connect the first dummy line L1 to the output line LO of the dummy stage SD by removing the insulation layer between the first dummy line L1 and the output line LO. Moreover, the laser is irradiated on an overlapping portion P2 of the first dummy line L1 and the output line LO2 of the second stage S2 to electrically connect the first dummy line L1 with the output line LO2 of the second stage S2 by removing the insulation layer between the first dummy line L1 and the output line LO2. Thus, the output line LO of the dummy stage SD and the output line LO2 of the second stage S2 are electrically connected through the first dummy line L1.

Moreover, the laser is irradiated on an overlapping portion P3 of the second dummy line L2 and the input line LO of the dummy stage SD to electrically connect the second dummy line L2 with the input line L1 of the dummy stage SD by removing the insulation layer between second dummy line L2 and the input line LO. Then, the laser is irradiated on an overlapping portion P4 of the second dummy line L2 and the input line LI2 of the second stage S2 to electrically connect the second dummy line L2 with the input line LI2 of the second stage S2 by removing the insulation layer between the second dummy line L2 and the input line LI2. Thus, the input line L1 of the dummy stage SD and the input line LI2 of the second stage S2 are electrically connected through the second dummy line L2.

Furthermore, the laser is irradiated to an overlapping portion P6 of the third dummy line L3 and the output line LO of the dummy stage SD to electrically connect the third dummy line L3 with the output line LO of the dummy stage SD by removing the insulation layer between the third dummy L3 and the output line LO. Also, the laser is irradiated to an overlapping portion P7 of the third dummy line L3 and the input line LI3 of the third stage S3 to electrically connect the third dummy line L3 with the input line LI3 of the third stage S3 by removing the insulation layer between the third dummy line L3 and input line LI3. Thus, the output line LO of the dummy stage SD and the input line LI3 of the third stage S3 are electrically connected through the third dummy line L3.

Even further, a laser is irradiated at a point P5 between the output terminal TO2 of the second stage S2 and a crossing point N2 of the input line LI3 of the third stage S3 and the output line LO2 of the second stage, thereby electrically disconnecting the crossing point N2 from the second stage S2 to prevent the second stage S2 from generating an unnecessary output.

Thus, when the first start signal VSt is provided at the input terminal TI1 of the first stage S1, the first stage S1 shifts the first start signal VSt from its input terminal TI1 to its output terminal TO1 to output a second start signal, which corresponds to the first start signal VSt shifted by one CLK period. The second start signal from the output terminal TO1 of the first stage S1 is inputted as a start signal at the input terminal TI2 of the second stage S2 and at the input terminal TI of the dummy stage SD. The dummy stage SD shifts the second start signal outputted by the first stage S1 from its input terminal TI to its output terminal TO to putout a third start signal, which corresponds to the second start signal shifted by one CLK period. The third start signal from the output TO of the dummy stage SD is inputted to the input terminal TI3 of the third stage S3. A corresponding signal from the output terminal TO2 of the second stage S2 is prevented from reaching the input terminal TI3 of the third stage S3. The third stage S3 shifts the third clock signal from its input terminal TI3 to its output terminal TO3 by one CLK period in accordance with the CLK signal.

Figure 7:
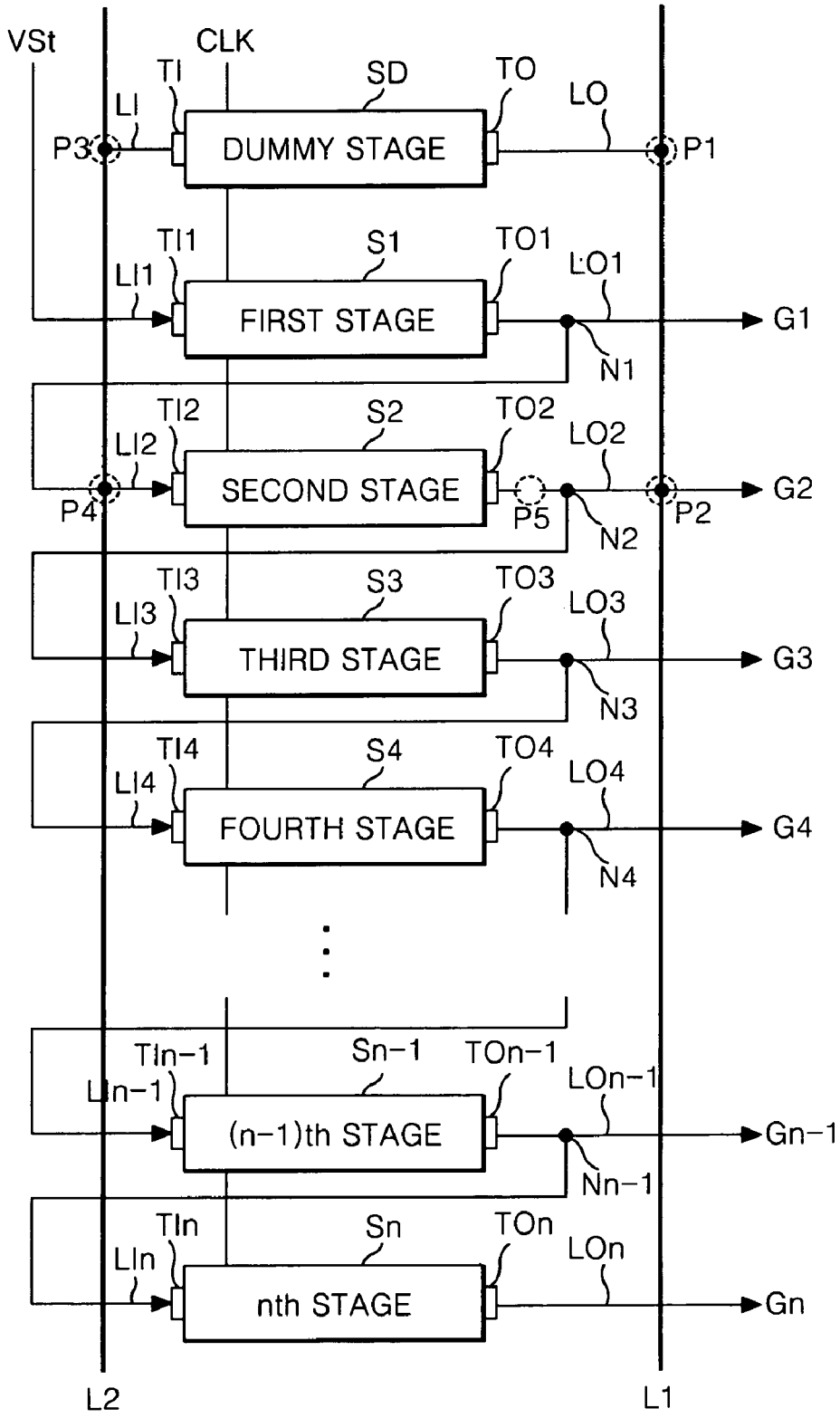
FIG. 7 is schematic description illustrating a method of repairing a gate drive circuit according to another embodiment of the present invention.

FIG. 7 is schematic description illustrating a method of repairing a gate drive circuit according to another embodiment of the present invention. Referring to FIG. 7, a repairable gate drive circuit 12 has a similar structure as the repairable gate drive circuit of FIG. 5 except that no third dummy line is provided. Thus, the gate drive circuit 12, shown in FIG. 4, includes first to $n^{th}$ stages S1 to Sn having respective input lines LI1 to LIn connected to start input terminals TI1 to Tin and respective output lines LO1 to LOn connected to output terminals TO1 to TOn. The input lines L12 to LIn of the second to $n^{th}$ stages S2 to Sn are each connected to the output lines LO1 to LOn−1 of the respective previous stages S1 to Sn−1, respectively.

A dummy stage SD having a substantially similar circuit configuration as the one of the first to $n^{th}$ stages S1 to Sn is formed together with the first to $n^{th}$ stages S1 to Sn. For example, the dummy stage SD also includes the input line LI connected to the start input terminal TI and the output line LO connected to the output terminal TO.

The gate drive circuit 12 includes a first dummy line L1. The first dummy line L1 partially overlaps the output line LO of the dummy stage SD and the output lines LO1 to LOn of the first to $n^{th}$ stages S1 to Sn. An insulating layer (not shown) is provided between the first dummy line L1 and each of the overlapped output lines LO, and LO1 to LOn. The first dummy line L1 may be electrically connected to the output line LO of the dummy stage SD and to the output line LOk of a $k^{th}$ stage Sk, where k is an integer from 1 to n by using laser irradiation.

The gate drive circuit 12 also includes a second dummy line L2. The second dummy line L2 partially overlaps the input line LI of the dummy stage SD and the input lines LI1 to LIn of the first to $n^{th}$ stages S1 to Sn. An insulating layer (not shown) is provided between the second dummy line L2 and each of the overlapped input lines LI, and LI1 to LIn. The second dummy line L2 may be electrically connected to the input line LI of the dummy stage SD and the input line LIk of the $k^{th}$ stage Sk, where k is an integer from 1 to n by using laser irradiation.

As shown in FIG. 7, when the second stage S2 of the gate drive circuit 12 fails to operate in a normal manner, the gate drive circuit 12 is repaired by irradiating a laser on an overlapping portion P1 of the first dummy line LI and the output line LO of the dummy stage SD to electrically connect the first dummy line LI to the output line LO of the dummy stage SD. Moreover, the laser is irradiated on an overlapping portion P2 of the first dummy line LI and the output line LO2 of the second stage S2 to electrically connect the first dummy line LI with the output line LO2 of the second stage S2. Thus, the output line LO of the dummy stage SD and the output line LO2 of the second stage S2 are electrically connected through the first dummy line LI.

Thus, when the first start signal VSt is provided at the input terminal TI1 of the first stage S1, the first stage S1 shifts the first start signal VSt from its input terminal TI1 to its output terminal TO1 to output a second start signal, which corresponds to the first start signal VSt shifted by one CLK period. The second start signal from the output terminal TO1 of the first stage S1 is inputted as a start signal at the input terminal TI2 of the second stage S2 and at the input terminal TI of the dummy stage SD. The dummy stage SD shifts the second start signal outputted by the first stage S1 from its input terminal TI to its output terminal TO to putout a third start signal, which corresponds to the second start signal shifted by one CLK period. The third start signal from the output TO of the dummy stage SD is inputted to the input terminal TI3 of the third stage S3. A corresponding signal from the output terminal TO2 of the second stage S2 is prevented from reaching the input terminal TI3 of the third stage S3. The third stage S3 shifts the third clock signal from its input terminal TI3 ti its out terminal TO3 by one CLK period in accordance with the CLK signal.

Moreover, the laser is irradiated on an overlapping portion P3 of the second dummy line L2 and the input line LO of the dummy stage SD to electrically connect the second dummy line L2 with the input line LI of the dummy stage SD. Then, the laser is irradiated on an overlapping portion P4 of the second dummy line L2 and the input line LI2 of the second stage S2 to electrically connect the second dummy line L2 with the input line LI2 of the second stage S2. Thus, the input line LI of the dummy stage SD and the input line LI2 of the second stage S2 are electrically connected through the second dummy line L2.

Furthermore, a laser is irradiated at a point P5 between the output terminal TO2 of the second stage S2 and a crossing point N2 of the input line LI3 of the third stage S3 and the output line LO2 of the second stage, thereby electrically disconnecting the crossing point N2 from the second stage S2 to prevent the second stage S2 from generating an unnecessary output. Thus, the output line LO of the dummy stage SD and the input line LI3 of the third stage S3 are electrically connected through the first dummy line LI.

In accordance with an embodiment of the present invention, the repairable gate drive circuit, the repairing method thereof, and the LCD device using the same include a dummy stage, which can be substituted for an abnormal stage to repair the gate drive circuit. Accordingly, the defect rate of the gate drive circuit can be reduced thereby reducing manufacturing cost.

It will be apparent to those skilled in the art that various modifications and variations can be made in the repairable gate drive circuit, the repairing method thereof, and the LCD device using the same of embodiments of the present invention. Thus, it is intended that embodiments of the present invention cover the modifications and variations of the embodiments described herein provided they come within the scope of the appended claims and their equivalents.

What is claimed is:

1. A gate drive device, comprising:

first, second and third stages formed on a substrate of a liquid crystal display panel, each of which for shifting a signal from an input thereof to an output thereof;

a dummy stage having a substantially similar circuit configuration as one of the first, second and third stages, the dummy stage for shifting a signal from an input thereof to an output thereof, wherein the dummy stage and the first, second and third stages are arranged along a straight line on the substrate;

a first dummy line partially overlapping the respective outputs of the dummy stage and of the first, second, and third stages with a first insulation layer between the first dummy line and each of the respective overlapped outputs;

a second dummy line partially overlapping the respective inputs of the dummy stage and of each of the first, second, and third stages with a second insulation layer between the second dummy line and each of the respective overlapped inputs; and a third dummy line partially overlapping the output of the dummy stage and the respective inputs of each of the first, second, and third stages with a third insulation layer between the third dummy line and the output of the dummy stage and a fourth insulation layer between the third dummy line and each of the overlapped inputs of the first, second, and third stages, wherein the output of the first stage is electrically connected to the input of the second stage, and the output of the second stage is electrically disconnected from the input of the third stage, wherein the first dummy line is located at output terminals of the dummy, first, second and third stages, the third dummy line is located at input terminals of the dummy, first, second and third stages and the second dummy line is located between the third dummy line and the input terminals of the dummy, first, second and third stages, wherein if the second stage fails to operate in a normal manner, the first dummy line is connected to the output line of the dummy stage and to the output line of the second stage, respectively, the second dummy line is connected to the input line of the dummy stage and to the input line of the second stage, respectively, and the third dummy line is electrically connected to the output line of the dummy stage and to the input line of a next stage of the second stage, and wherein when a laser is irradiated between the output terminal of the second stage and a crossing point of the input of the third stage and the output of the second stage so that the crossing point is disconnected from the second stage, the output of the dummy stage and the input of the third stage are electrically connected through the first dummy line.

2. The gate drive device of claim 1, wherein, when the second stage malfunctions, the outputs of the dummy stage and of the second stage are electrically connected through the first dummy line by removing the first insulation layer between the first dummy line and each of the dummy stage and the second stage, and the input of the dummy stage and of the second stage are electrically connected through the second dummy line by removing the second insulation layer between the second dummy line and each of the dummy stage and the second stage.

3. A liquid crystal display device, including the gate drive device of claim 1.

4. The gate drive device of claim 3, wherein the second stage is prevented from shifting the second start signal to the input of the third stage.

5. The gate drive device of claim 1, wherein the first stage shifts a first start signal from the input thereof for outputting a second start signal to the output thereof, the dummy stage shifts the second start signal from the input thereof for outputting a third start signal to the output thereof, and the third stage shifts the third start signal from the input thereof to the output thereof.

6. A liquid crystal display device, including the gate drive device of claim 5.

7. The gate drive device of claim 1, wherein the dummy stage and the first to third stages are formed on a same substrate.

8. A gate drive device, comprising:

first, second and third stages formed on a substrate of a liquid crystal display panel, each of which for shifting a signal from an input thereof to an output thereof;

a dummy stage having a substantially similar circuit configuration as one of the first, second and third stages, the dummy stage for shifting a signal from an input thereof to an output thereof, wherein the dummy stage and the first, second and third stages are arranged on a same column line of the substrate;

a first dummy line partially overlapping the respective outputs of the dummy stage and of the first, second, and third stages with a first insulation layer between the first dummy line and each of the respective overlapped outputs;

a second dummy line partially overlapping the respective inputs of the dummy stage and of each of the first, second, and third stages with a second insulation layer between the second dummy line and each of the respective overlapped inputs; and a third dummy line partially overlapping the output of the dummy stage and the respective inputs of each of the first, second, and third stages with a third insulation layer between the third dummy line and the output of the dummy stage and a fourth insulation layer between the third dummy line and each of the overlapped inputs of the first, second, and third stages, wherein the first stage shifts a first start signal from the input thereof for outputting a second start signal to the output thereof, the dummy stage shifts the second start signal from the input thereof for outputting a third start signal to the output thereof, and the third stage shifts the third start signal from the input thereof to the output thereof, wherein the first dummy line is located at output terminals of the dummy, first, second and third stages, the third dummy line is located at input terminals of the dummy, first, second and third stages and the second dummy line is located between the third dummy line and the input terminals of the dummy, first, second and third stages, wherein if the second stage fails to operate in a normal manner, the first dummy line is connected to the output line of the dummy stage and to the output line of the second stage, respectively, the second dummy line is connected to the input line of the dummy stage and to the input line of the second stage, respectively, and the third dummy line is electrically connected to the output line of the dummy stage and to the input line of a next stage of the second stage, and wherein when a laser is irradiated between the output terminal of the second stage and a crossing point of the input of the third stage and the output of the second stage so that the crossing point is disconnected from the second stage, the output of the dummy stage and the input of the third stage are electrically connected through the first dummy line.

9. The gate drive device of claim 8, wherein, when the second stage malfunctions, the outputs of the dummy stage and of the second stage are electrically connected through the first dummy line by removing the first insulation layer between the first dummy line and each of the dummy stage and the second stage, and the input of the dummy stage and of the second stage are electrically connected through the second dummy line by removing the second insulation layer between the second dummy line and each of the dummy stage and the second stage.

10. A liquid crystal display device, including the gate drive device of claim 8.

11. The gate drive device of claim 8, wherein the second stage is prevented from shifting the second start signal to the input of the third stage.

12. A method of repairing a gate drive device, which includes first, second and third stages, each of which for shifting a signal from an input thereof to an output thereof, and a dummy stage having a substantially similar circuit configuration as one of the first, second and third stages, the dummy stage for shifting a signal from an input thereof to an output thereof, the method comprising:

partially overlapping a first dummy line with the respective outputs of the dummy stage and of the first, second, and third stages;

providing a first insulation layer between the first dummy line and each of the respective overlapped outputs;

partially overlapping a second dummy line with the respective inputs of the dummy stage and of each of the first, second, and third stages;

providing a second insulation layer between the second dummy line and each of the respective overlapped inputs, partially overlapping a third dummy line with the output of the dummy stage and the respective inputs of each of the first, second, and third stages;

providing a third insulation layer between the third dummy line and the output of the dummy stage and a fourth insulation layer between the third dummy line and each of the overlapped inputs of the first, second, and third stages;

electrically connecting the output of the first stage to the input of the second stage, electrically connecting the outputs of the dummy stage and of the second stage through the first dummy line by removing the first insulation layer between the first dummy line and each of the dummy stage and the second stage, electrically connecting the input of the dummy stage and of the second stage through the second dummy line by removing the second insulation layer between the second dummy line and each of the dummy stage and the second stage, and preventing an output from the second stage from reaching the input of the third stage, wherein the first dummy line is located at output terminals of the dummy, first, second and third stages, the third dummy line is located at input terminals of the dummy, first, second and third stages and the second dummy line is located between the third dummy line and the input terminals of the dummy, first, second and third stages, and wherein the first, second and third stages and the dummy stage are arranged along a straight line on a substrate of a liquid crystal display panel, wherein if the second stage fails to operate in a normal manner, the first dummy line is connected to the output line of the dummy stage and to the output line of the second stage, respectively, the second dummy line is connected to the input line of the dummy stage and to the input line of the second stage, respectively, and the third dummy line is electrically connected to the output line of the dummy stage and to the input line of a next stage of the second stage, and wherein when a laser is irradiated between the output terminal of the second stage and a crossing point of the input of the third stage and the output of the second stage so that the crossing point is disconnected from the second stage, the output of the dummy stage and the input of the third stage are electrically connected through the first dummy line.

13. The method of claim 12, including:

shifting a first start signal from the input of the first stage for outputting a second start signal to the output thereof, shifting the second start signal from the input of the dummy stage for outputting a third start signal to the output thereof, and shifting the third start signal from the input of the third stage shifts to the output thereof.

14. The method of claim 12, including forming the dummy stage and the first to third stages on a same substrate.

15. The method of claim 12, wherein preventing an output from the second stage from reaching the input of the third stage includes electrically disconnecting the output of the second stage from the input of the third stage.

* * * * *